US005671991A

United States Patent [19]

Grant

[11] Patent Number: 5,671,991

[45] Date of Patent: Sep. 30, 1997

[54] CABINET

[75] Inventor: Alexander Grant, Caithness, United Kingdom

[73] Assignee: Norfrost Limited, United Kingdom

[21] Appl. No.: 397,049

[22] PCT Filed: Sep. 9, 1993

[86] PCT No.: PCT/GB93/01904

§ 371 Date: May 3, 1995

§ 102(e) Date: May 3, 1995

[87] PCT Pub. No.: WO94/07097

PCT Pub. Date: Mar. 31, 1994

[30] Foreign Application Priority Data

Sep. 11, 1992 [GB] United Kingdom ..... 9219279

[51] Int. Cl.[6] ..... A47B 96/00

[52] U.S. Cl. ..... 312/406; 312/400; 312/401; 220/467

[58] Field of Search ..... 312/406, 401, 312/400, 278, 236; 220/467, 421, 669

[56] References Cited

U.S. PATENT DOCUMENTS

| | | | |
|---|---|---|---|
| 332,417 | 12/1885 | McKenzie | 312/406 X |
| 1,529,115 | 3/1925 | Campbell | 52/316 X |
| 1,608,046 | 11/1926 | Stanley | 220/669 X |
| 2,031,701 | 2/1936 | Forsthoefel | 220/467 |
| 2,107,076 | 2/1938 | Mason | 312/236 X |
| 2,185,953 | 1/1940 | Ruthenburg | 220/467 |
| 2,201,596 | 5/1940 | Teeter | 220/467 X |
| 3,150,796 | 9/1964 | Hocking et al. | 312/401 X |
| 4,043,624 | 8/1977 | Lindenschmidt | 312/406 |
| 4,157,762 | 6/1979 | Robinson | 220/669 |
| 5,168,621 | 12/1992 | Kruck et al. | 312/406 X |

FOREIGN PATENT DOCUMENTS

| | | | |
|---|---|---|---|
| 608593 | 5/1959 | Italy | 220/467 |
| 516449 | 1/1940 | United Kingdom | 220/467 |

*Primary Examiner*—Peter M. Cuomo
*Assistant Examiner*—David E. Allred
*Attorney, Agent, or Firm*—Sixbey, Friedman, Leedom & Ferguson; Gerald J. Ferguson, Jr.; David S. Safran

[57] ABSTRACT

A temperature-controlled cabinets, particularly, refrigerators, freezers, fridge-freezers and drinks coolers (chillers) which, in order to overcome the problem of inferior insulative properties of alternative polyurethane foams used to reduce the emission of CFC's during injection and setting of foamed polyurethane, provides a cabinet within which a controllable stable temperature may be maintained. This cabinet includes an inner container (25*a*), an outer shell (10*a*), and a thermally insulating material (45*a*) sandwiched therebetween, wherein at least a portion of a front side (50*a*) of the outer shell (10*a*) has a panel (85*a*) which is displaced outwardly from the rest of the front side (50*a*) of the outer shell (10*a*). In a preferred embodiment, the cabinet forms a chest freezer (5*a*).

9 Claims, 7 Drawing Sheets

CABINET

Figure 1:
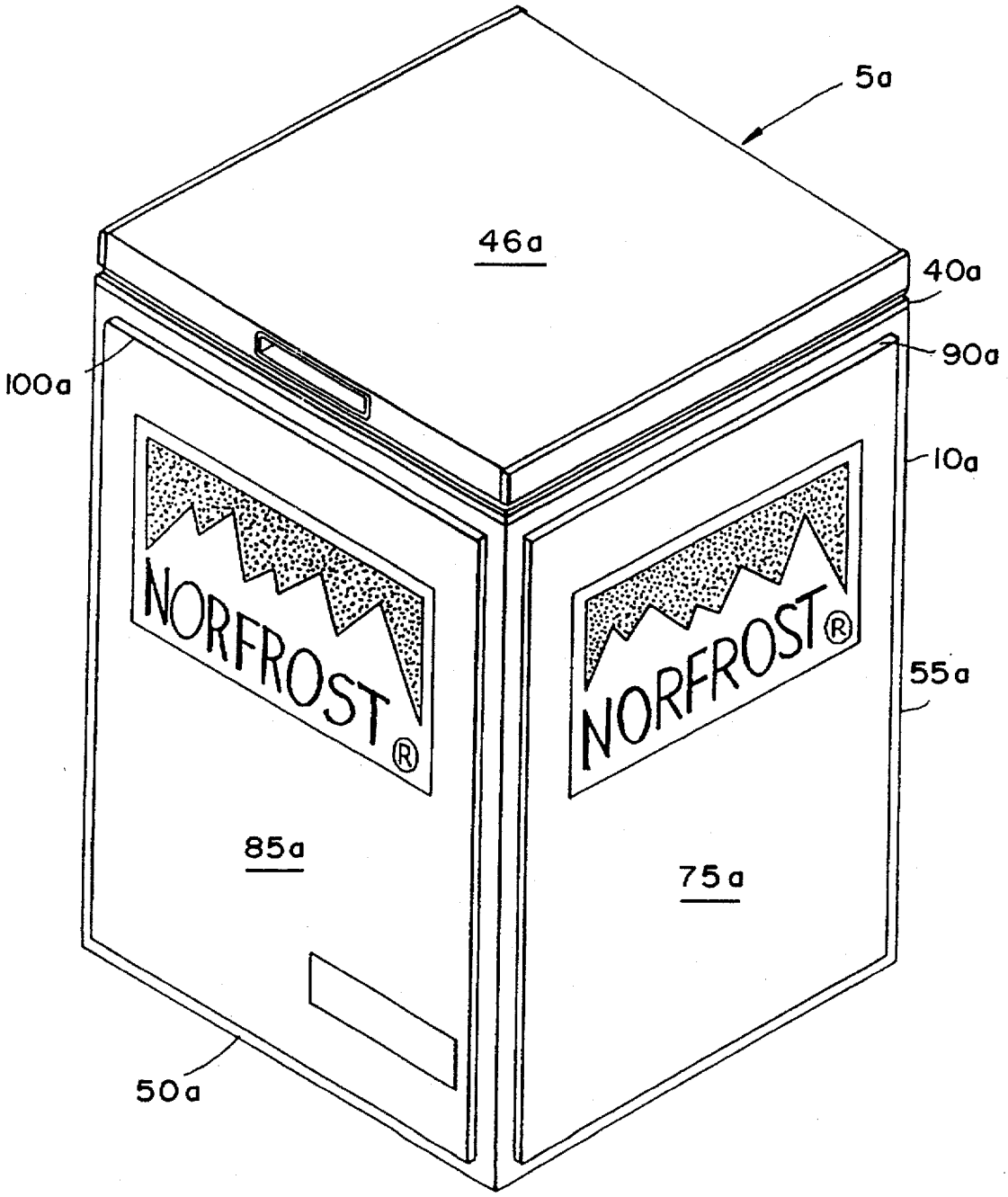

This invention relates to temperature-controlled cabinets, particularly refrigerators (fridges), freezers, fridge-freezers and drinks coolers (chillers).

In freezers, for example, it is common to have an outer shell of sheet steel and an inner container of aluminium sheet, between which a layer of foamed polyurethane is injected. The polyurethane acts both as thermal insulation, and as a structural part, since it bonds to the outer shell and to the inner container.

In order to reduce the emission of CFC's during injection and setting of the foamed polyurethane, efforts have recently been made to use alternative polyurethane foams. For example, the blowing agent used in the polyurethane foam has been changed from R11 to pentene.

A problem exists with these alternative foams, however, in that the insulative properties thereof tend to be inferior to those of conventionally used foams. This, therefore, means that refrigerators/freezers using the alternative foams tend to be less efficient, and consume more electrical power, in use. This deficiency in thermal insulation could be compensated for by increased thickness of the substitute foam. However, this leads to greater difficulties in other respects because of the need to accommodate the additional thickness of foam within the cabinet. Thus one is faced with a dilemma of either reduced internal load capacity or increased overall size of cabinet. Neither of these solutions would be attractive to a consumer. In the latter instance one must also take account of the need to accommodate such cabinets between standard sized units used in modern kitchen designs.

From the point of view of the manufacturing industry alteration of the overall dimensions of the cabinet has even more serious implications due to increased material coats, re-design of tooling to handle and assemble the cabinets, not to mention also the need to re-design and produce a totally new packaging for the products using such larger cabinets.

It is, therefore, an object of the present invention to obviate or mitigate the aforementioned problems.

It is a further object of the present invention to improve the electrical efficiency of refrigerators (fridges), freezers, fridge freezers and drinks coolers (chillers).

Another object of this invention is to provide a cabinet of satisfactory thermal efficiency which can be handled during assembly and packaged without radical re-design of production line, thereby enabling use of existing machinery and packaging.

Yet other objects of at least some embodiments of the present invention include: to provide a visually more appealing cabinet; and to provide a cabinet with enhanced advertising space. This latter object is particularly applicable to cabinets made for commercial use.

Accordingly, in a first aspect of the present invention there is provided a cabinet within which a controllable stable temperature may be maintained, the cabinet including an inner container and an outer shell, a thermally insulating material being sandwiched therebetween, wherein at least a portion of a front of the outer shell comprises a panel which is displaced outwardly from the rest of the front of the outer shell.

According to a second aspect of the present invention there is provided a cabinet within which a controllable stable temperature may be maintained the cabinet including an inner container having sides of substantially rectangular shape and an outer shell having sides of substantially rectangular shape, a thermally insulating material being sandwiched therebetween, wherein at least a portion of a front of the outer shell comprises a panel which is displaced outwardly from and substantially parallel with the rest of the front.

At least a portion of at least one side of the outer shell may comprise a further panel which is displaced outwardly from the rest of the at least one side.

The cabinet may be adapted to be used as a refrigerator, freezer, drinks cooler or as an oven by fitment of appropriate control equipment.

The cabinet may be of a chest or front-opening type. In the latter case, the front comprises a door.

The panel(s) is/are preferably of substantially the same shape as the front/side(s) of the cabinet, peripheral edges of the panel being located near to corresponding peripheral edges of the front/side(s).

The panel(s) may be substantially parallel to the front/side(s) of the cabinet.

The panel(s) may be integrally connected to peripheral edges of the front/side(s) by a step which may be of any suitable shape, e.g. flat or curved.

The step may be formed by a suitable pressing tool which presses the panel out from the front/side(s), during manufacture of the cabinet.

Graphic material such as advertising matter, or the like, may be provided on the panel(s), the panel(s) providing enhanced advertising space for such material on the front/side(s) of the cabinet.

The panel of this invention may conveniently be called an "energy panel".

According to a third aspect of the present invention there is provided an outer shell for use in a cabinet according to either the first or second aspects of the present invention, wherein the outer shell has a front providing a panel which is displaced outwardly from and substantially parallel with respect to the front.

According to a fourth aspect of the present invention there is provided a method of manufacturing a temperature-controlled cabinet, comprising forming an outer shell having a front in which a panel is displaced outwardly from the plane of the front, forming an inner container, assembling the outer shell and inner container in relation to one another and filling a space formed therebetween with a thermally insulating material.

Thus by virtue of this invention it is possible to improve the thermal efficiency of a cabinet for containing a controllable stable temperature zone, such a cabinet being of generally cuboidal shape and comprising an inner container of volume $V_1$ defining a zone capable of being temperature-controlled by associated heat pumping means to maintain a predetermined temperature irrespective of ambient temperature, an external shell enclosing the inner container and a thermal barrier material interposed between the shell and the inner container, wherein the shell has peripheral edge dimensions 1, b, and h and is characterised by expansion of at least a portion of a front of the shell by pressing or the like means whereby the volume $V_2$ confined between the shell and the inner container exceeds the value of $\{(1\times b\times h)—V_1\}$.

According to a fifth aspect of the present invention there is provided a cabinet within which a controllable stable temperature may be maintained, the cabinet including an inner container and an outer shell, a thermally insulating material being sandwiched therebetween, wherein at least a portion of the outer shell comprises a panel which is displaced outwardly from the rest of the outer shell.

Advantages of such a cabinet include that the peripheral edge portions of the shell of the cabinet which provide contact points between the cabinet and the equipment handling the cabinet during assembly, and also packaging, remain unchanged which also allows existing packaging collars to be used and yet the cabinet in fact accommodates a larger volume of insulation beneath the raised panel surface portions of the shell.

Figure 2:
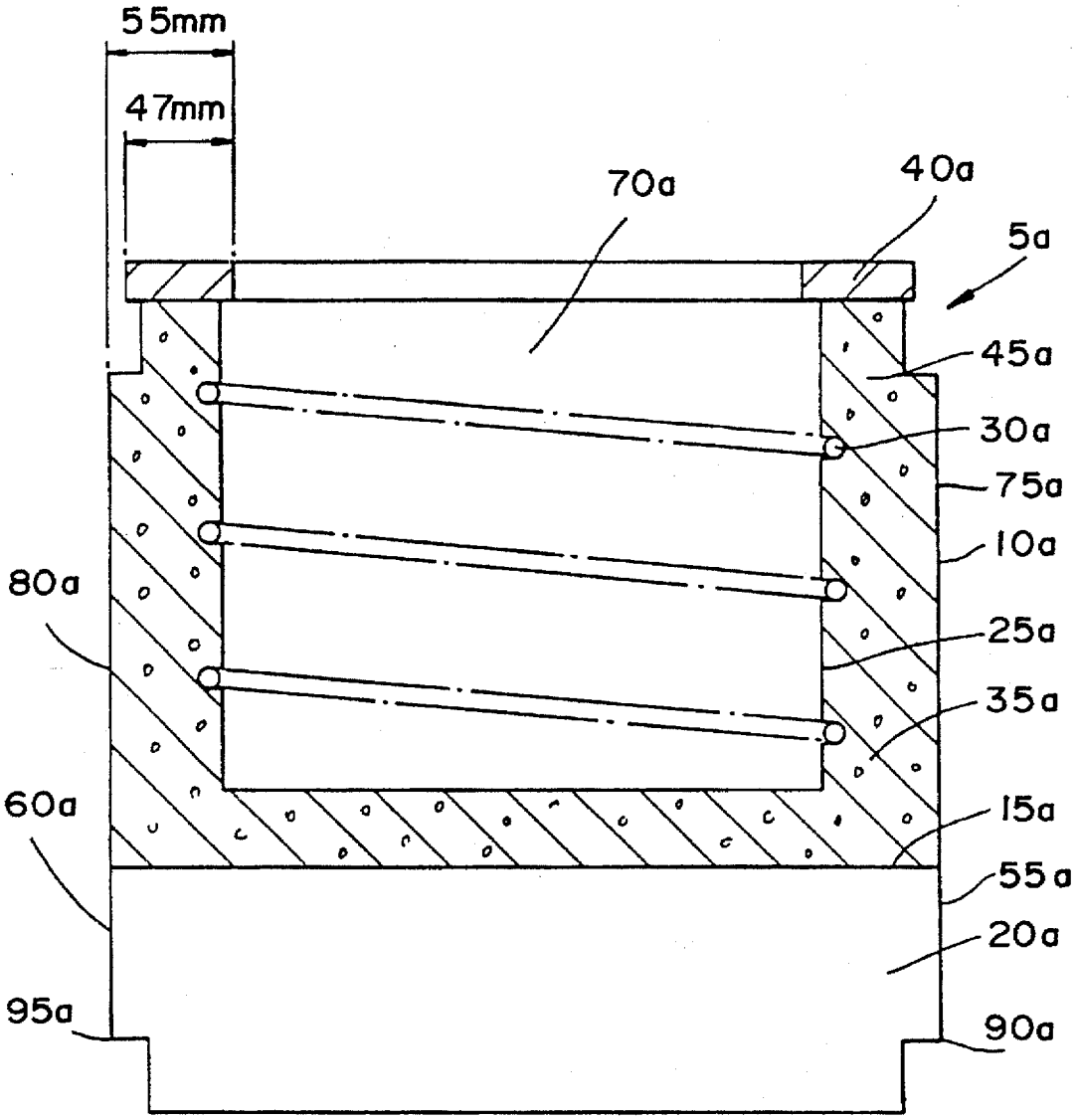
Figure 3:
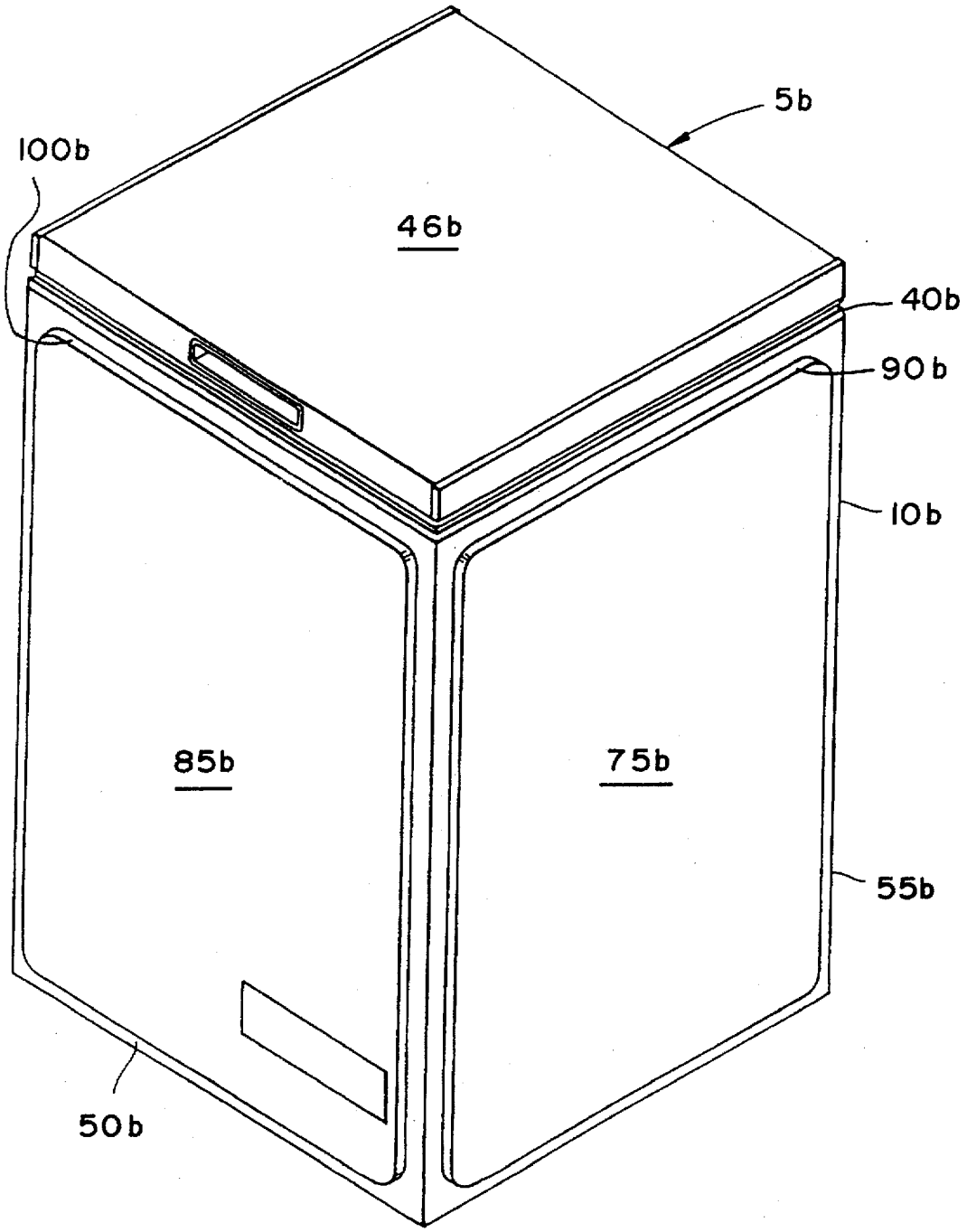
Figure 4:
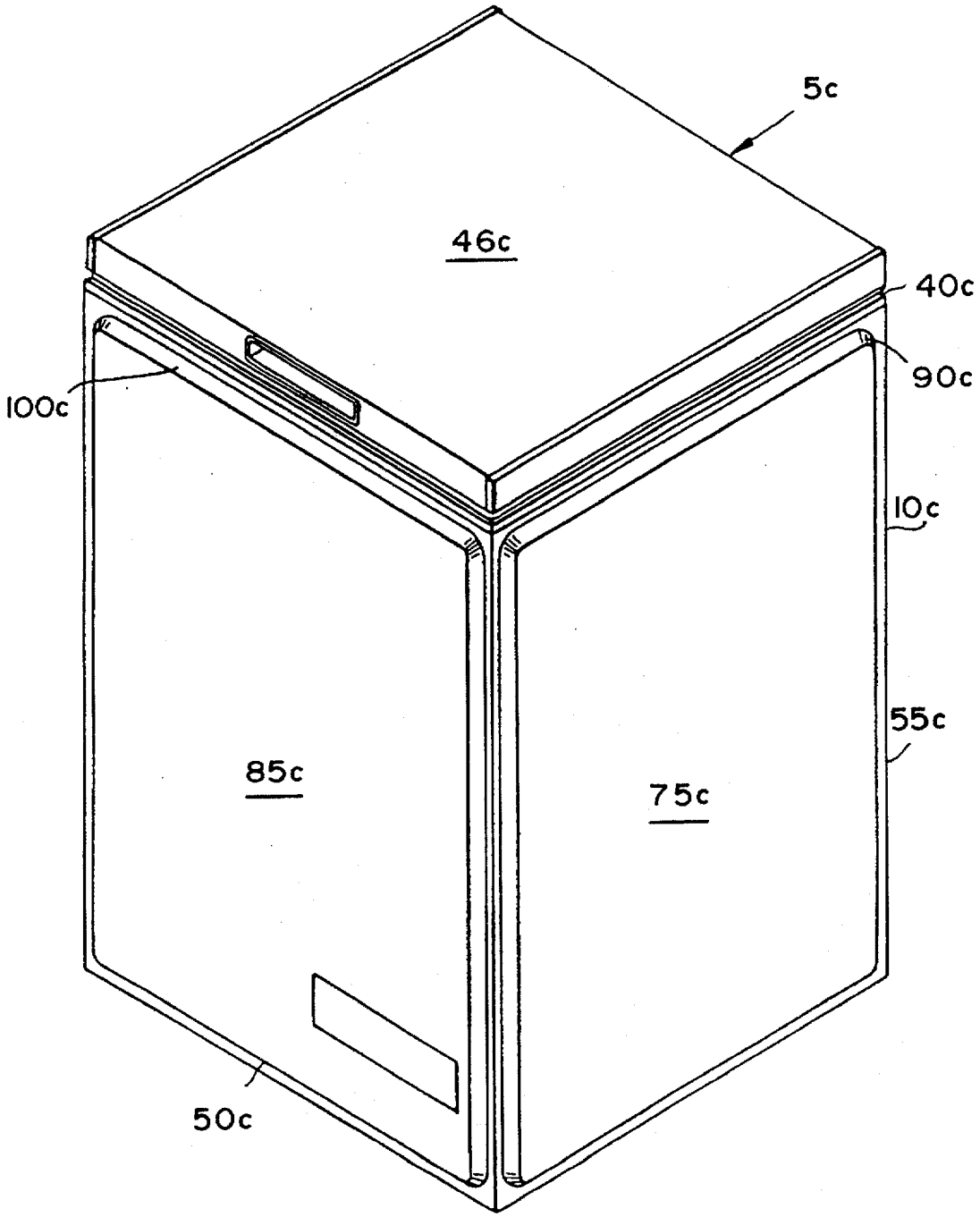
Figure 5:
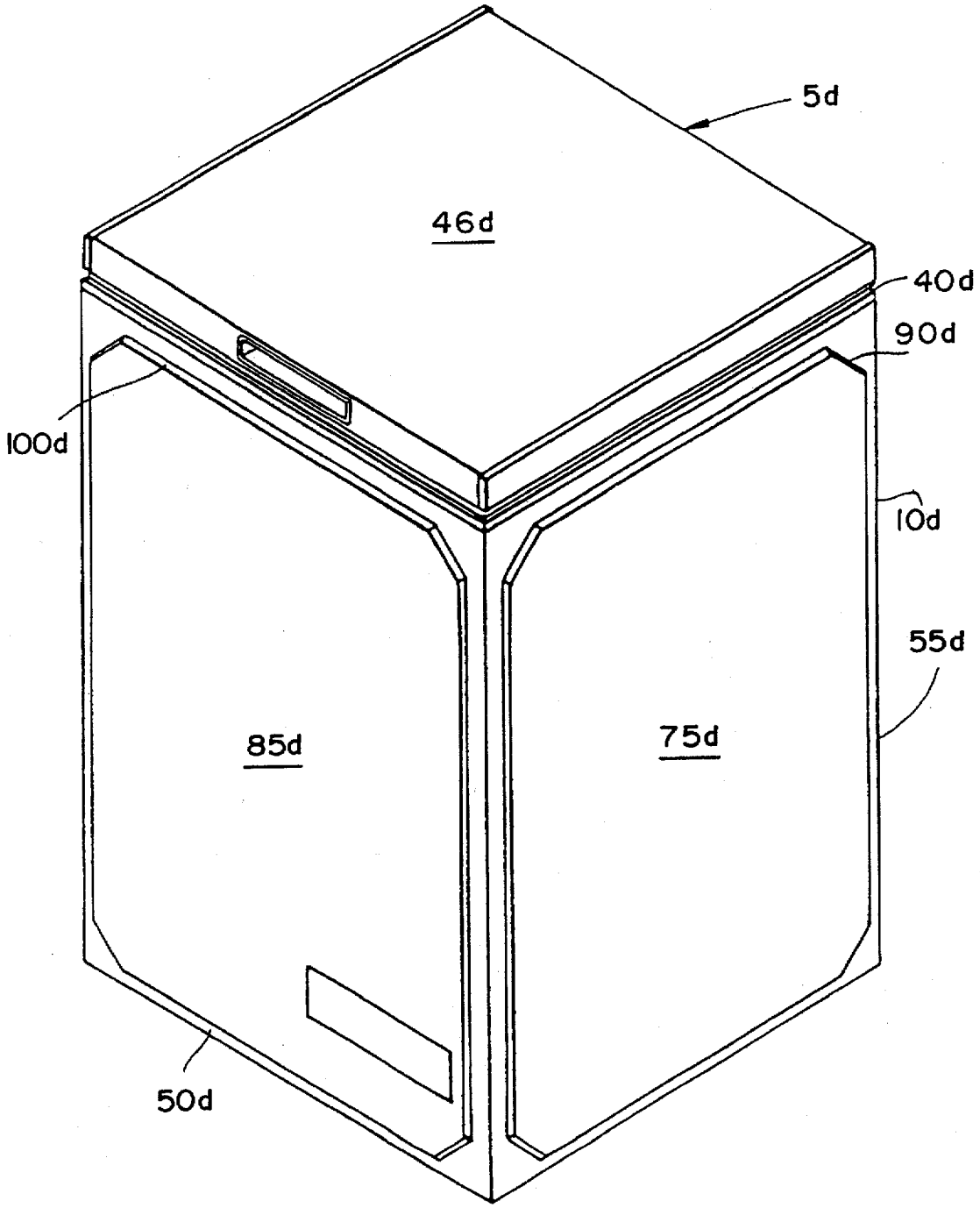
Figure 6:
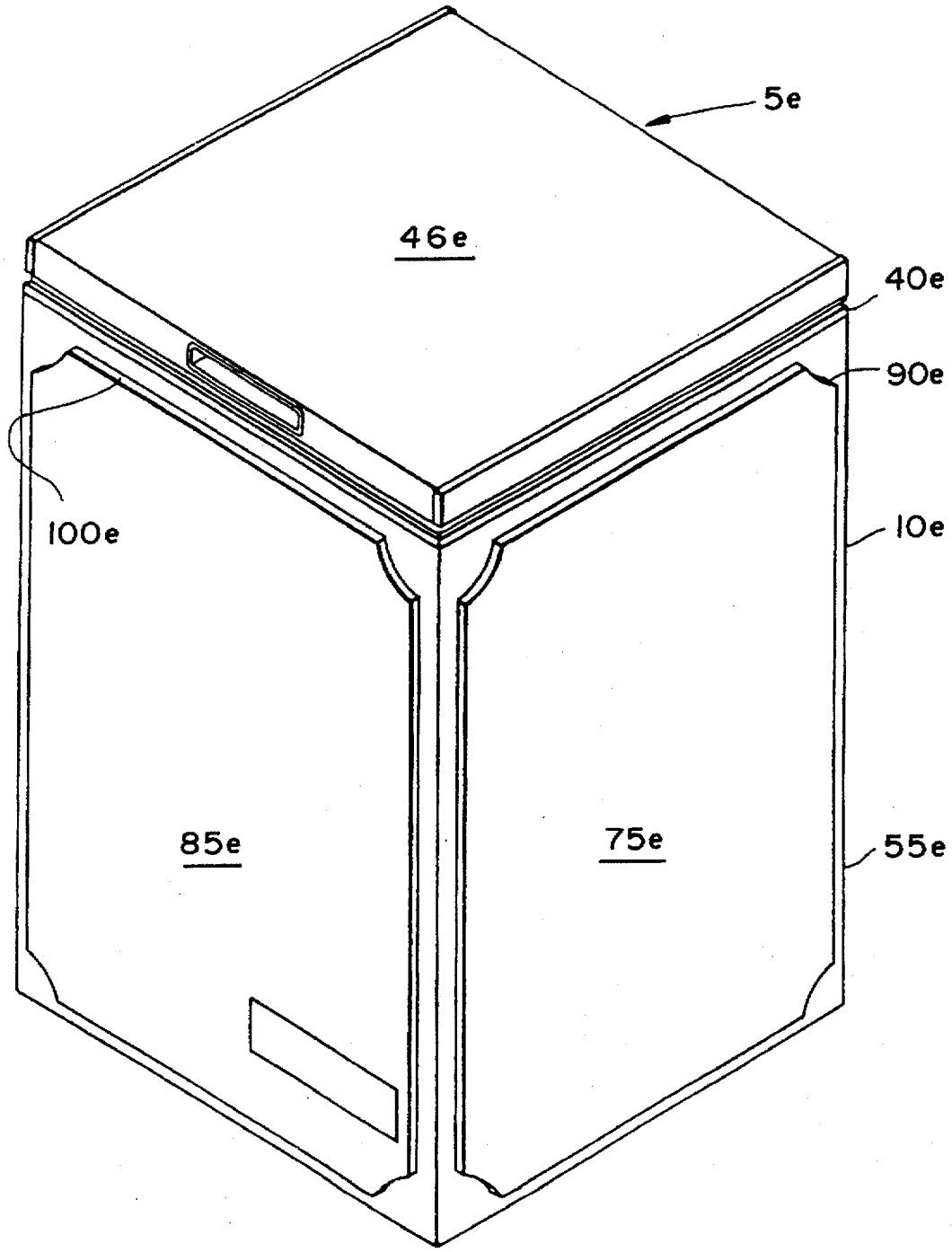
Figure 7:
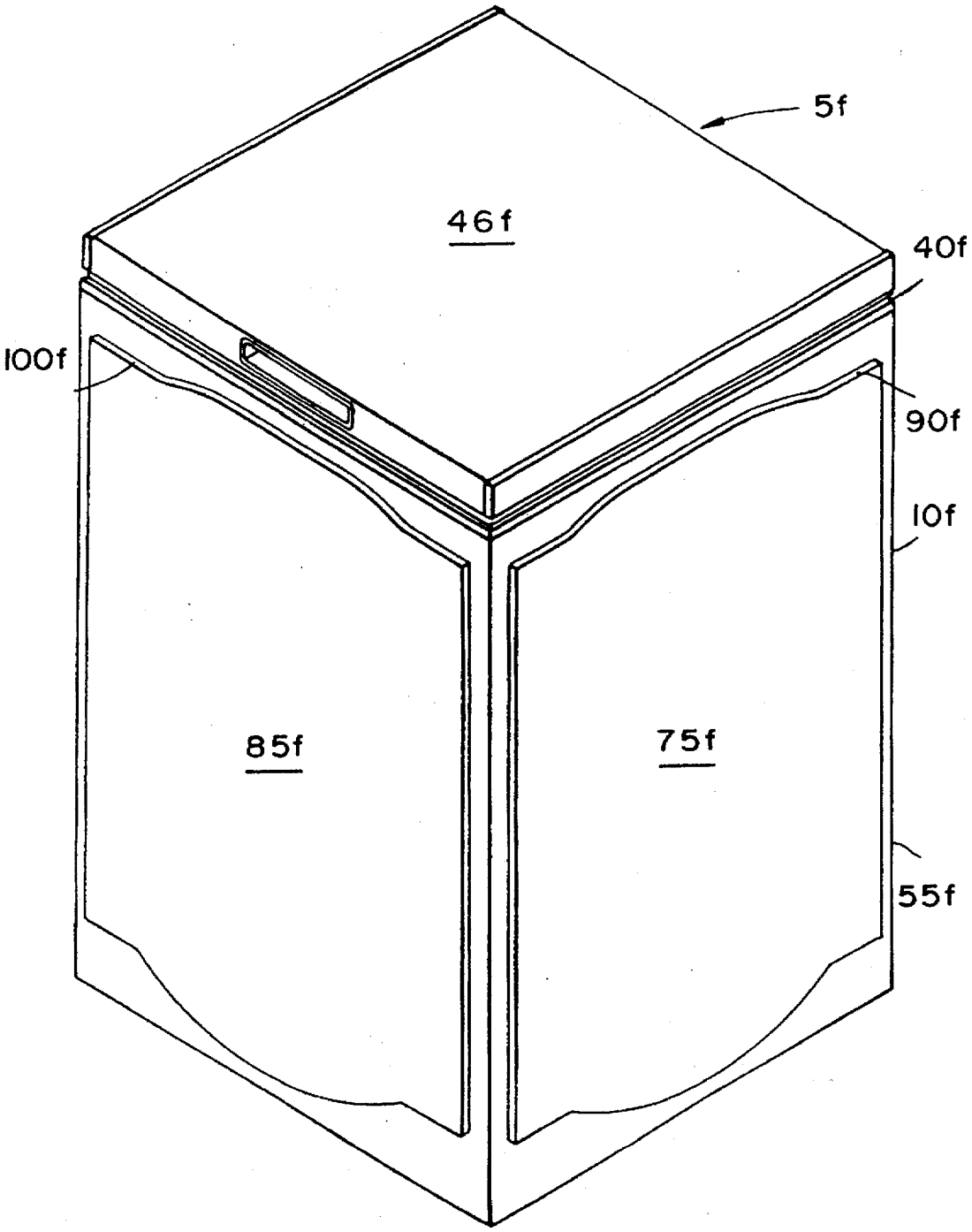

Embodiments of the present invention will now be described, by way of example only, with reference to the accompanying drawings which are:

FIG. 1 a schematic perspective view from above and to one side of a first embodiment of a chest freezer according to the present invention;

FIG. 2 a schematic cross-sectional front view of the chest freezer of FIG. 1 to a reduced scale;

FIG. 3 a schematic perspective view from above and to one side of a second embodiment of a chest freezer according to the present invention;

FIG. 4 a schematic perspective view from above and to one side of a third embodiment of a chest freezer according to the present invention;

FIG. 5 a schematic perspective view from above and to one side of a fourth embodiment of a chest freezer according to the present invention;

FIG. 6 a schematic perspective view from above and to one side of a fifth embodiment of a chest freezer according to the present invention;

FIG. 7 a schematic perspective view from above and to one side of a sixth embodiment of a chest freezer according to the present invention.

Referring to FIGS. 1 and 2, there is provided a first embodiment of a chest freezer unit having a point at its center defining the inward direction of the unit, the unit is, generally designated 5*a*, according to the present invention comprising a sheet steel outer body or shell 10*a* having a transverse partition 15*a* defining a space 20*a* for accommodating a compressor unit (not shown). Within the outer body 10*a* there is provided an inner container 25*a* of aluminium sheet which is surrounded by a refrigerant coil 30*a*. The coil 30*a* is retained on the inner container 25*a* by means of an adhesive tape (not shown) which surrounds the coil 30*a* and container 25*a* so as to sandwich the coil 30*a* between an inner facing surface of the tape and the outer facing surface of the container 25*a*. The container 25*a* defines a cavity surrounding a center point of the cabinet. The coil 30*a* and compressor unit form conventional heat pump means.

A space 35*a* is provided between the outer shell 10*a* and the inner container 25*a*. A moulded plastic member 40*a* is used to seal the space 35*a* at its uppermost extremity between the uppermost edges of the container 25*a* and shell 10*a*.

The space 35*a* is filled with an insulative material such as polyurethane foam 45*a*, which not only acts as insulation but also bonds to the facing surfaces of the container 25*a* and shell 10*a*, thereby forming part of the structure of the unit 5*a*.

A hinged lid 46*a* is normally provided on top of the unit 5*a* in order to provide closeable access to the inner container 25*a*.

In this embodiment the outer shell 10*a* is substantially square in horizontal cross-section—similar to the conventional 3.8 cubic feet capacity "Ice Chef" (Trade Mark) chest freezer presently manufactured by the Applicant. The shell 10*a*, therefore, comprises a front 50*a*, first and second sides 55*a*, 60*a*, and a rear 70*a*.

As can be seen from FIGS. 1 and 2, in the unit 5*a* according to this embodiment of the invention, first, second and third panels 75*a*, 80*a*, 85*a* are provided respectively on the first and second sides 55*a*, 60*a* and on the front 50*a*. The first panel 75*a* is integrally connected to the first side 55*a* by means of a first step 90*a*, the first panel 75*a* and first step 90*a* being formed by pressing of the shell 10*a* during manufacture thereof. Similarly, the second and third panels 80*a*, 85*a* are integrally connected to the second side 60*a* and the front 50*a* respectively by means of second and third steps 95*a*, 100*a* which are similarly formed during manufacture.

The first panel 75*a*, is of substantially the same shape as, though smaller than, the first side 55*a*. The peripheral edges of the first panel 75*a* are, therefore, approximately 10 to 100 mm away from the corresponding peripheral edges of the first side 55*a*. The second and third panels 80*a*, 85*a* are similarly shaped and dimensioned. Further, the steps 90*a*, 95*a*, 100*a* are approximately 5 to 15 mm deep, and preferably in the region of 8 to 10 mm.

The provision of the panels 75*a*, 80*a*, 85*a* increases the volume of the space 35*a* between the outer shell 10*a* and inner container 25*a*, and consequently the amount of insulator 45*a* which can be used. This results in an estimated saving of between 10% to 20% of electrical power consumed by the freezer unit 5*a*. Even higher electrical efficiencies may be obtained with alternative higher insulation value materials, such as silica.

This saving is provided while negating the need for expensive retooling of manufacturing plant associated with the manufacturer of the freezer units 5*a*, while also negating the need for changes to be made to the packaging of same. Also, since the packaging of the units 5*a* according to the invention is the same as for those units without provision of the "panels" then the same number of units can be transported. There is, therefore, no increase in the cost of transportation.

As can best be seen from FIG. 1, lettering or other graphic materials may be provided on the panel(s) 75*a*, 80*a*, 85*a*. The lettering or graphic materials may, for example, be painted on the panel(s) 75*a*, 80*a*, 85*a* or be provided on a poster(s) suitably adhered to the panel(s) 75*a*, 80*a*, 85*a*. It has been found that the panels 75*a*, 80*a*, 85*a* provide enhanced space for such lettering or graphic material as compared to conventional flat sided units, thereby providing improved eye-catching advertising space for freezers 5*a* used in commercial situations. This is particularly important in the use of the present invention as a drinks cooler where soft-drink manufacturers often place their brand-name logo or Trade Mark on the front/side(s) of the cooler so that the customer can quickly distinguish where to locate the manufacturers goods, for example, in a shop, sports facility or the like.

In use as a drinks cooler the invention may be provided with a toughened transparent plastic lid 46*a*.

Referring now to FIGS. 3 to 7 there are illustrated second to sixth embodiments of chest freezer units according to the present invention, generally designated 5*b* to 5*f* respectively, like parts being identified by the same integers as in the first embodiment shown in FIG. 1 but suffixed by 'b' to 'f' respectively rather than by 'a'.

The embodiments shown in FIGS. 3 to 7 are substantially identical to the first embodiment shown in FIG. 1 excepting that the panels 75*b*, 80*b*, 85*b* to 75*f*, 80*f*, 85*f* are of different shapes. Particularly, the units 5*d* to 5*f* of FIGS. 5 to 7 have panels particularly adapted to appear similar to doors of kitchen units, or the like, in order to provide a unified design look to, for example, a fitted kitchen.

The embodiments of the invention hereinbefore described are given by way of example only, and are not meant to limit the scope of the invention in any way.

Particularly, it should be understood that the invention may be applied to refrigerator units and drinks coolers, wherein expected energy savings would be in the region of 20% to 40% of electrical power consumed.

Further, the invention may be applied to either chest or front-opening freezers or refrigerator units. If the invention is applied to front-opening units then a "panel" may be provided on the door, i.e. front, thereof.

I claim:

1. A cabinet within which a controllable stable temperature is maintainable, the cabinet having a point at its center defining an inward direction of the cabinet, said cabinet comprising an inner container having four sides of substantially rectangular shape and defining a cavity surrounding said center point, said cabinet further comprising an outer shell having a front side and first and second laterals sides of substantially rectangular shape, wherein a portion of the front side of the outer shell has a panel in a plane which is displaced outwardly relative to other portions of the front side; wherein a portion of each of the first and second lateral sides of the outer shell has a respective further panel in a plane which is displaced outwardly relative to other portions of said lateral sides, wherein a thermally insulating foam material fills a space formed between the inner container and outer shell including the outwardly displaced panels; and wherein first and second edges formed between said other portions of the front side and the first lateral side and between said other portions of the front side and the second lateral side respectively, provide edges of the cabinet which are located outwardly relative to adjacent edges on said panels.

2. A cabinet as claimed in claim 1, wherein the cabinet is provided with comparative control equipment for enabling the cabinet to be used as a refrigerator, freezer or drinks cooler.

3. A cabinet as claimed in claim 1, wherein the cabinet is provided with temperature control equipment for enabling the cabinet to be used as an oven.

4. A cabinet as claimed in claim 2, wherein the cabinet is of a chest type.

5. A cabinet as claimed in one of claims 1, 2, 3 or 4 wherein each of the panels is substantially of the same shape as the respective side of the cabinet, peripheral edges of each panel being located adjacent to corresponding peripheral edges of the respective side without being coincident therewith.

6. A cabinet as claimed in claim 1, wherein each of the panels is substantially parallel to the respective side of the cabinet.

7. A cabinet as claimed in claim 1, wherein each of the panels integrally connects to the peripheral edges of the respective side by a step.

8. A cabinet as claimed in claim 1, wherein graphic material is provided on at least one of the panels.

9. A method of manufacturing a temperature controlled cabinet with a point at its center defining the inward direction relative to the cabinet wherein, the method comprises:

forming an outer shell having a front side and first and second lateral sides;

forming a panel on the front side in a plane which is displaced outwardly relative to other portions of said front side;

forming a panel on each lateral side in a plane which is displaced outwardly from other portion of the respective lateral side;

forming an inner container having fours sides of substantially rectangular shape which define a cavity surrounding said center point;

assembling the outer shell and inner container in relation to one another such that first and second edges formed between said other portions of the front side and the first lateral side, and between said other portions of the front side and the second lateral side, respectively, comprise first and second outermost edges of the cabinet which are located outwardly relative to adjacent edges on said panels; and filling a space formed between the inner container and outer shell including the panels with a thermal insulating foam material.

* * * * *